US008573744B2

(12) United States Patent
Kashu et al.

(10) Patent No.: US 8,573,744 B2
(45) Date of Patent: Nov. 5, 2013

(54) CONTINUOUS TYPE LIQUID EJECTION HEAD AND LIQUID EJECTION DEVICE

(75) Inventors: Ryota Kashu, Kawasaki (JP); Koichi Kitakami, Chigasaki (JP); Akio Saito, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 78 days.

(21) Appl. No.: 13/178,771

(22) Filed: Jul. 8, 2011

(65) Prior Publication Data

US 2012/0033015 A1 Feb. 9, 2012

(30) Foreign Application Priority Data

Aug. 6, 2010 (JP) ..... 2010-177947
Apr. 6, 2011 (JP) ..... 2011-084591

(51) Int. Cl.
*B41J 2/14* (2006.01)

(52) U.S. Cl.
USPC ..... 347/47

(58) Field of Classification Search
USPC ..... 347/73
See application file for complete search history.

(56) References Cited

U.S. PATENT DOCUMENTS 6,357,866 B1 * 3/2002 van Rensburg ..... 347/75
7,926,902 B2 * 4/2011 Umeda ..... 347/19

FOREIGN PATENT DOCUMENTS

JP 2005-205752 A 8/2005

* cited by examiner

*Primary Examiner* — Lisa M Solomon
(74) *Attorney, Agent, or Firm* — Fitzpatrick, Cella, Harper & Scinto

(57) ABSTRACT

A continuous type liquid ejection head includes an ejection opening plate formed with ejection openings, from which a pressurized liquid is ejected, and a deforming unit. The ejection opening plate is made of an elastic plate containing a rubber material, at least at portions that are formed with the ejection openings. The deforming unit is arranged adjacent to the ejection opening plate and is configured to deform the elastic plate so that areas of the ejection openings are periodically changed.

8 Claims, 7 Drawing Sheets

CONTINUOUS TYPE LIQUID EJECTION HEAD AND LIQUID EJECTION DEVICE

BACKGROUND OF THE INVENTION

1. Field of the Invention

The present invention relates to a continuous type liquid ejection head that ejects a liquid, such as an ink, and a liquid ejection device in which the liquid ejection head is mounted. In the following description, an ink is taken as a typical example of the liquid.

2. Description of the Related Art

A variety of proposals have been made for liquid ejection heads mounted in liquid ejection devices represented by ink-jet printing apparatus. Among them is a continuous type liquid ejection head. This type of liquid ejection head periodically vibrates ink at around 100 kHz by a vibration unit as the ink pressurized by a pump is ejected from an ejection opening in the form of an ink column just outside the ejection opening. The vibrations applied from the vibration unit form regular constrictions in the ink column according to the frequency given to the vibration unit, with the result that the constrictions in the ink column grow by the surface tension of the ink until the liquid column breaks up into a series of ink droplets.

In the continuous type liquid ejection head, to form a series of ink droplets, it is necessary to distinguish, according to print data, ink droplets used for printing from those not used. One such example involves selectively charging ink droplets with static electricity to deflect them by an electric field. A method called binary scheme uses uncharged ink droplets for printing and arrests and recovers charged ink droplets by gutters. To realize these functions, a charging electrode, a deflection electrode and a gutter are provided along ink flying paths from the ejection openings.

In recent years, to mitigate deformations of a print medium (curling and cockling) caused by water in ink ejected from the liquid ejection head, the use of highly viscous ink with a reduced amount of water is being studied. Some of the existing commercially available printers deal with the problem of print medium deformations due to water contained in ink by installing a drying unit of heater in the printer body. If the ejection of highly viscous ink becomes possible, this eliminates the need for the drying unit, reducing power consumption and the size of the printer. Further, the highly viscous ink ejection is also being considered for applications where the liquid ejection head device is used as a liquid application device and a pattern forming device to form patterns on functional materials of industrial products.

When a conventional continuous type liquid ejection head is used to eject highly viscous ink and break it up into a series of droplets at a frequency of around 100 kHz, a distance required to break up an ink column into droplets (hereinafter called a droplet forming distance) is more than a few millimeters, which is greater than that of low viscous ink. This is because the flow speed of the highly viscous ink is more retarded by the surface tension than that of a low viscous ink. The longer droplet forming distance inevitably leads to such problems as a degradation in landing precision and an increased size of the head.

To transform a highly viscous ink column into a series of droplets within a droplet forming distance almost equal to or shorter than that of the conventional continuous type liquid ejection head that uses a low viscous ink, an ink column, as it comes out of the ejection opening, needs to be reliably formed with constrictions. To this end, the head must be constructed to ensure that periodic vibrations (pressure variations) produced by the vibration unit can be transmitted efficiently to the ink column that is formed as the ink is ejected from the ejection opening. That is, the head needs to be constructed in a way that can impart with higher efficiency the force produced by the vibration unit to the ink being ejected from the ejection opening.

A method of ejecting a highly viscous ink has been known, as disclosed in Japanese Patent Laid-Open No. 2005-205752. In this method, an elastic member is formed in a pressure chamber that communicates with ejection openings from which ink is ejected. The elastic member is depressed and displaced by a piezoelectric member, which is an actuator, through a vibrating plate to reduce a volume of the pressure chamber. In this construction, since the vibrating plate is pressed against the elastic member, the deflection of the vibrating plate can be minimized. As a result, the major change in the volume of the pressure chamber is caused not by the deflection of the vibrating plate but by the compressive deformation of the elastic member. Therefore, that portion of the force of the actuator which is used in deflecting the vibrating plate becomes minimal, allowing the force that the actuator has applied to the vibrating plate to be transmitted to ink more efficiently.

However, in the construction of Japanese Patent Laid-Open No. 2005-205752, since the elastic member and the ejection openings are remote from each other, there is a pressure loss, which in turn attenuates the force that the actuator has applied to the vibrating plate before it reaches the ejection openings. Even if a large pressure change is produced near the vibrating plate, it is attenuated to a small pressure change near the ejection openings. When the construction of Japanese Patent Laid-Open No. 2005-205752 is applied to a continuous type liquid ejection head, it is considered not possible to give large enough flow changes to an ink column being ejected. So, this construction is not an efficient one to realize the ejection of ink with even higher viscosity.

Further, in the conventional continuous type liquid ejection head that uses low viscous ink (5 cP or lower), the ink column ejected from the ejection opening is formed with regular constructions by vibrations of the vibrating unit and then separated into a series of droplets by the surface tension of the ink. Here the distance required to separate an ink column into a series of droplets is 1 mm or less. However, where a high viscosity ink is used, the flow speed of the ink becomes slower, so that to separate the ink column into a series of droplets by the surface tension alone requires a distance of a few millimeters or more. The longer droplet forming distance gives rise to problems such as degradations of landing precision and an increased size of the print head. To keep the droplet forming distance for high viscosity ink equal to or less than that of the conventional continuous type liquid ejection head, it is necessary to apply a force more efficiently to the ink column being ejected from the ejection opening to produce greater flow changes in the ink column.

SUMMARY OF THE INVENTION

An object of this invention is to provide a continuous type liquid ejection head and a liquid ejection device that can solve the aforementioned problem and eject and separate highly viscous ink into a series of successive droplets more efficiently than in conventional liquid ejection heads and devices.

The continuous type liquid ejection head of this invention comprises: an ejection opening plate formed with ejection openings from which to eject a pressurized liquid and made of an elastic plate at least portions that are formed with the ejection openings; and a deforming unit to deform the elastic plate so that areas of the ejection openings are periodically changed. With this invention, the ejection openings are formed in the elastic plate, which is deformed so that the areas of the ejection openings cyclically change to directly change the flow of ink columns ejected from the ejection openings by pressurizing the pressure chamber. Because the flow of the ink columns are changed directly by the ejection openings as they are cyclically changed in area, no pressure loss is produced, making it possible to transfer the force of the displacing elastic plate to the ink. As a result, a continuous type liquid ejection head and a liquid ejection device can be provided which can eject and separate highly viscous ink into a series of successive droplets more efficiently than in conventional heads and devices.

Further features of the present invention will become apparent from the following description of exemplary embodiments (with reference to the attached drawings).

DESCRIPTION OF THE EMBODIMENTS

Embodiments of this invention will be described in detail by referring to the accompanying drawings. It is noted, however, that this invention is not limited in any way by these embodiments.

Figure 1:
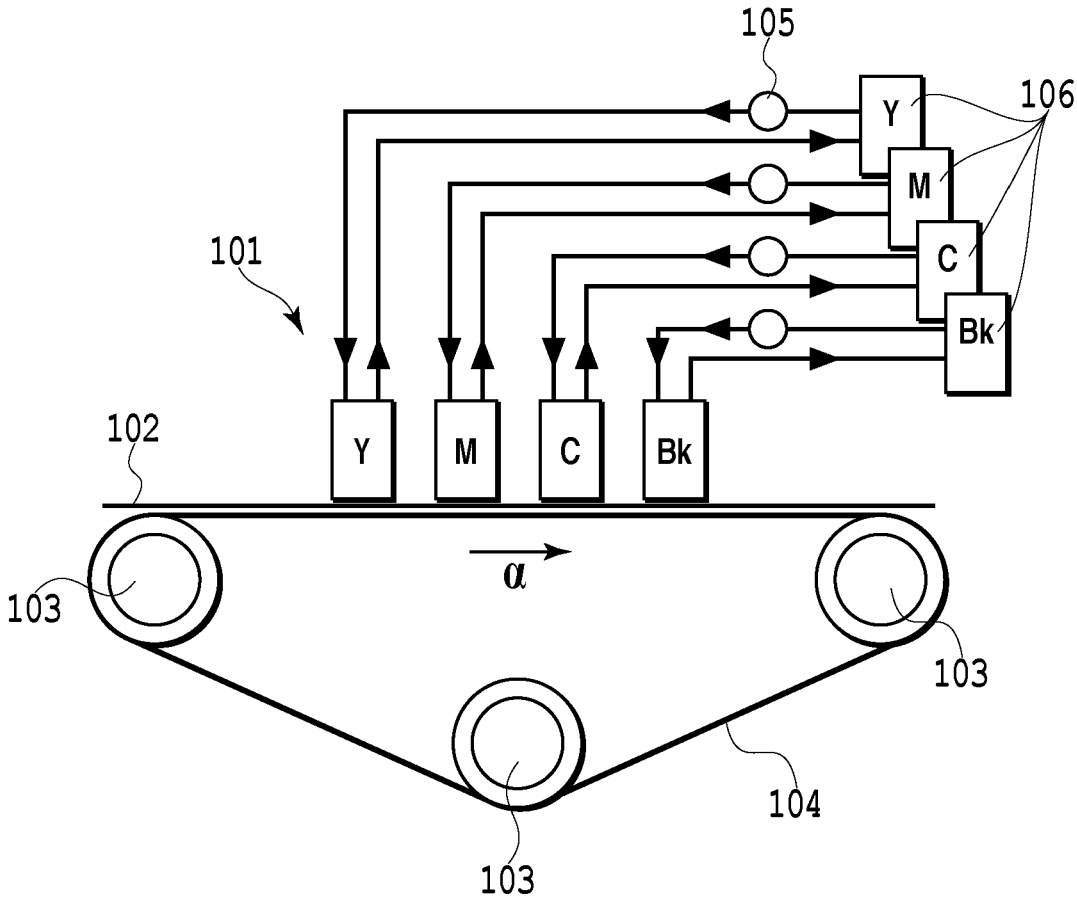
FIG. 1 is a schematic diagram showing a preferred construction of a continuous type liquid ejection device embodying a liquid ejection method of this invention.

FIG. 1 shows a preferred, schematic construction of a continuous type liquid ejection device embodying a liquid ejection method of this invention. This device has an endless conveying belt 104 tensely wound around conveying rollers 103, on which a print medium 102 is carried to be scanned in a direction of arrow as the conveying belt 104 is driven.

In the example of the liquid ejection device shown in FIG. 1, a line type liquid ejection head unit 101 is employed which has a printing element board formed with ejection openings arrayed over a range corresponding to a width of the print medium 102. In the example of FIG. 1, four liquid ejection head units 101, one each for yellow (Y), magenta (M), cyan (C) and black (Bk) ink, are arranged side by side in a print medium conveyance direction and driven to eject these color inks onto the print medium 102 as the print medium 102 is conveyed, to effect a high-speed full-color printing.

Figure 2:
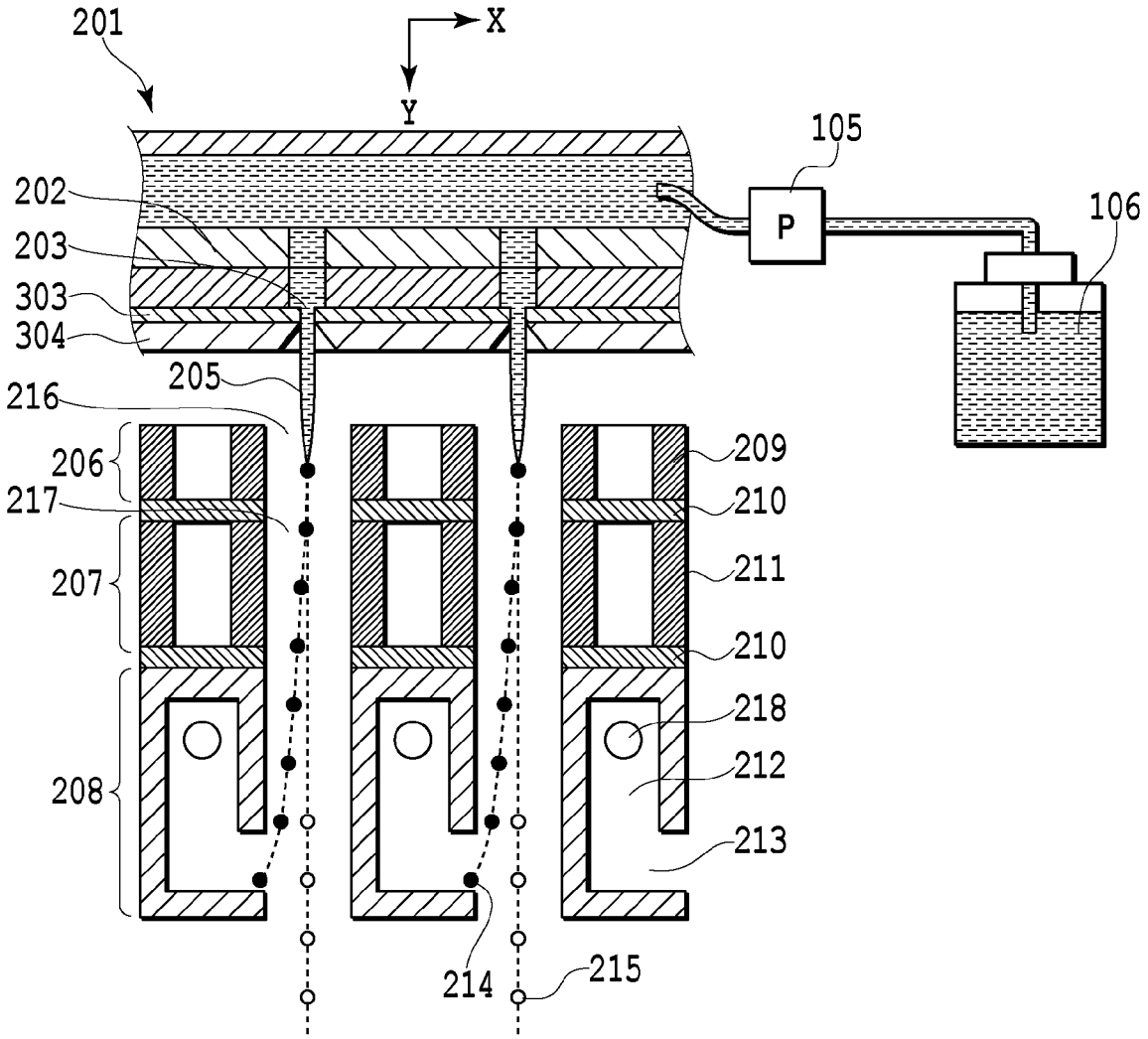
FIG. 2 is a schematic view of a charging/deflection/recovery unit for ink droplets installed in the continuous type liquid ejection device embodying the liquid ejection method of this invention.

An example construction of the liquid ejection head unit 101 is shown in FIG. 2 and comprises a liquid ejection head 201, a droplet charging unit 206, a droplet deflection unit 207 and a droplet recovery unit 208. The liquid ejection head 201 has ejection openings 203 through which ink columns 205 are ejected, a pressure chamber 202 communicating with the ejection openings 203, and an orifice plate (elastic plate) 303 formed with the ejection openings 203. The pressure chamber 202 is supplied a pressurized ink by a pump 105 from an ink tank 106 accommodated in the liquid ejection device. The pump 105 needs to have enough delivery pressure to eject ink from the ejection openings 203 in the form of liquid columns. More specifically, in the case of an ink of 40 cP, a few MPa (gauge pressure) is required.

The droplet charging unit 206, the droplet deflection unit 207 and the droplet recovery unit 208 are laminated in that order in the droplet ejection direction from the ejection openings 203 of the liquid ejection head 201. Each of these units will be explained in the following.

The droplet charging unit 206 has through-holes opposing the ejection openings 203, with a charging electrode 209 formed on an inner wall of each through-hole. The charging electrodes 209 are patterned to match individual ejection openings and wired to a charging drive circuit (not shown). From the tip of each of the ink columns 205 ejected from the ejection openings 203 a series of fine droplets are produced successively, flying at predetermined intervals and at a constant speed. The droplet charging unit 206 is so arranged that the separation of the liquid column into a series of successive droplets at the column tip occurs inside each of the through-holes of the droplet charging unit 206. A voltage to be applied to each charging electrode 209 is controlled based on image forming print data. That is, when a droplet to be used for printing (a non-charged droplet 215 represented by a blank circle in FIG. 2) separates itself from the ink column 205, no voltage is applied to the associated charging electrode 209, so the separated printing droplet is not electrically charged.

When on the other hand a droplet not to be used for printing, or a non-printing droplet, separates itself from the ink column 205, the associated charging electrode 209 is applied a positive or negative voltage, causing a current to flow through the ink forming the ink column 205 to induce on a surface of the ink column 205 an electric charge of a polarity opposite that of the charging electrode 209, with the result that the ink droplet just separated from the ink column 205 flies as a non-printing droplet. If the charging electrode 209 is applied, for example, a negative voltage, a positive charge is induced on the surface of the ink column 205, causing the separating droplet to fly as a positively charged, non-printing droplet (a charged droplet 214 represented by a solid black circle in FIG. 2).

The droplet deflection unit 207 has through-holes opposing the ejection openings 203, with two opposing deflection electrodes 211 formed on an inner wall of each through-hole. The deflection electrodes 211 are wired to a deflection drive circuit (not shown). Between the two deflection electrodes is constantly impressed a voltage that forms an electric field in each through-hole acting in a direction perpendicular to the ink ejection direction. The printing droplet that has flown past the droplet charging unit 206 (a non-charged droplet 215 represented by a blank circle in FIG. 2) is not charged and therefore travels straight past the droplet deflection unit 207 without being affected by the electric field. The charged non-printing droplet (a charged droplet 214 represented by a solid black circle in FIG. 2), on the other hand, is influenced by the electric field and deflected in the direction of -X in FIG. 2.

The droplet recovery unit 208 has through-holes opposing the ejection openings 203, with a gutter 213, or opening, formed in a part of an inner wall of each through-hole. Inside the unit there are formed recovery ink paths 212 communicating with the gutters 213. The non-printing droplets deflected by the droplet deflection unit 207 land on the gutters 213 from which they are recovered into the recovery ink paths 212. The printing droplets, on the other hand, fly straight past the through-holes of the droplet recovery unit 208 without being recovered by the gutters 213 and land on the print medium.

Embodiment 1

Figure 3:
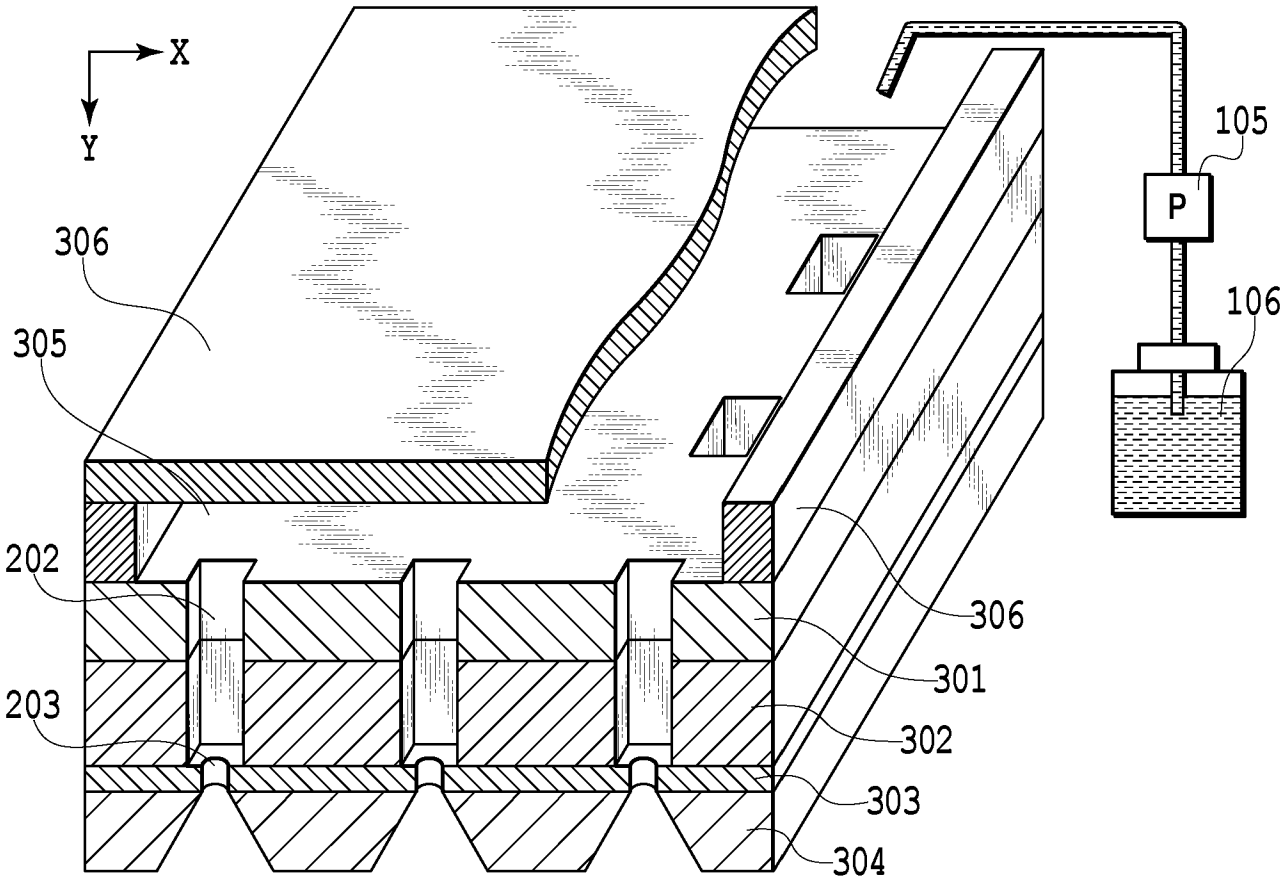
FIG. 3 is a perspective view of a continuous type liquid ejection head as an embodiment 1 of this invention.

FIG. 3 is a perspective view of a continuous type liquid ejection head as embodiment 1 of this invention. The head of this embodiment comprises an orifice plate 303 made of an elastic material and formed with ejection openings 203, a pressure chamber 202 communicating with the ejection openings 203, a common liquid chamber 305 communicating with the pressure chamber 202, and an elastic plate deforming unit 302 that deforms the elastic plate. The elastic plate preferably has a low Young's modulus and a high Poisson's ratio and may suitably use rubber materials such as silicone rubber and fluorocarbon rubber (with Young's modulus of 1.5-5.0 MPa and Poisson's ratio of 0.46-0.49). The elastic plate deforming unit 302 is directly connected to the elastic plate, the back side of which is formed with a holding member to hold the deforming unit. The elastic plate deforming unit 302 and the deforming unit holding member 301 combine to form the pressure chamber 202. Materials suited for the elastic plate deforming unit 302 are piezoelectric materials such as PZT, considering a force required to be generated by the liquid ejection head, a displacement of the elastic plate and a drive frequency.

On the underside of the orifice plate (elastic plate) 303, which has the elastic plate deforming unit 302 on its upper side, there is formed an elastic plate holding member 304 that restricts the deformation of the elastic plate in the Y direction. The elastic plate holding member 304 has through-holes opposing the ejection openings 203. The through-holes are preferably tapered with their upper end in contact with the ejection openings being narrowest. This is because, if the elastic plate holding member 304 is formed with through-holes of the same opening area as that of the ejection openings 203, a large flow resistance is produced as the ink columns pass through the elastic plate holding member 304, resulting in some of the energy generated by the displacement of the elastic plate being lost. With the through-holes tapered as described above, the ink columns do not come into contact with the inner walls of the elastic plate holding member 304, keeping the ink ejection energy intact.

Next, the method of driving the head in this embodiment will be explained. Pressurized ink is delivered by the pump from the ink tank in the liquid ejection device to the common liquid chamber 305, the pressure chamber 202 and the ejection openings 203, from which it is ejected in the form of ink columns. The elastic plate deforming unit 302, when it receives a drive signal, expands in the ink ejection direction. The deformation of the elastic plate deforming unit 302 in a direction opposite the ink ejection direction is restricted by the deforming unit holding member 301, so that it cannot deform toward the deforming unit holding member 301. As a result, the elastic plate deforming unit 302 compresses the elastic plate, reducing the areas of the ejection openings in the elastic plate.

Figure 4B:
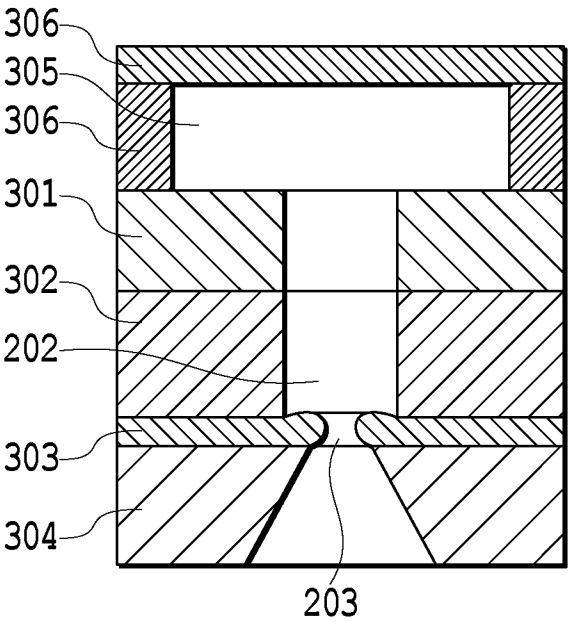
FIG. 4B is a cross section showing how the elastic member in the continuous type liquid ejection head of the embodiment 1 is deformed.
Figure 4A:
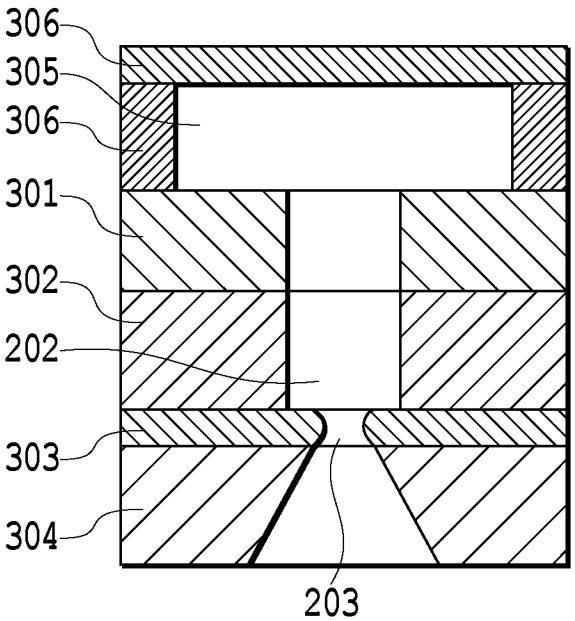
FIG. 4A is a cross section showing the elastic member in the continuous type liquid ejection head of the embodiment 1 before it is deformed.

This process is shown in FIG. 4A and FIG. 4B. FIG. 4A represents a state of the head before the elastic plate deforming unit 302 deforms and FIG. 4B a state after the elastic plate deforming unit 302 has deformed. According to the drive frequency, the elastic plate deforming unit 302 periodically deforms the elastic plate, which in turn periodically changes the areas of the ejection openings 203. The periodic changes in the areas of the ejection openings 203 can directly cause the ink columns to fluctuate in flow volume. This enables the deformation energy of the elastic plate deforming unit 302 to be imparted to the ink columns without causing any pressure loss. As a result, a more efficient continuous type liquid ejection head can be realized, capable of ejecting and separating a high viscosity ink into a series of successive droplets in a shorter distance.

For an experiment the inventors manufactured a head using silicone rubber (Young's modulus: 3.0 MPa; Poisson's ratio: 0.48) for the orifice plate (elastic plate) 5 μm thick, with the ejection openings set at 7.4 μm in diameter. An ink used has a viscosity of 42 cP and a surface tension of 36.7 mN/m. When the elastic plate deforming unit 302 was applied a drive voltage at 100 kHz, constrictions corresponding to the frequency of the applied voltage were formed in the ejected ink columns which were then separated at a droplet forming distance of 985 gm into a series of successive droplets. The droplets at this time were about 8 pl in size flying at 13.5 m/s.

Embodiment 2

Figure 5:
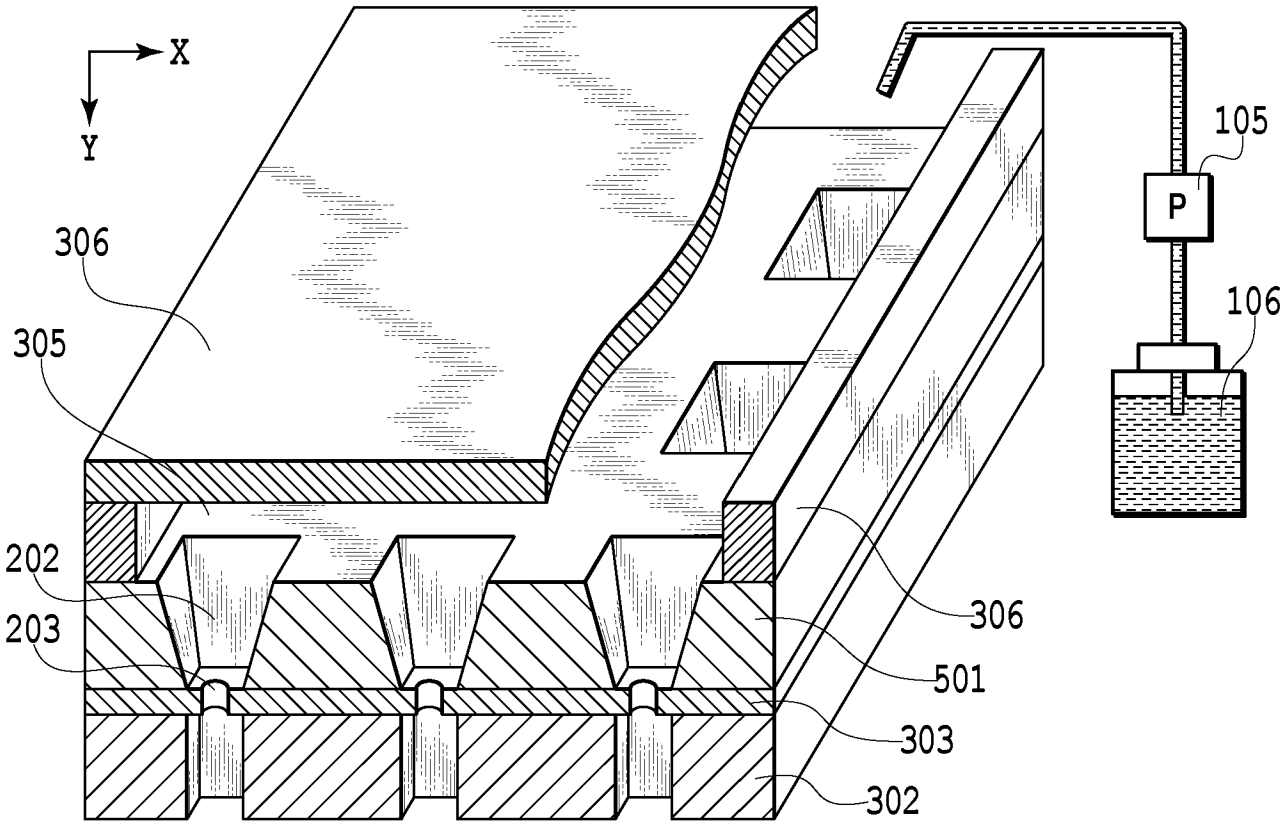
FIG. 5 is a perspective view of a continuous type liquid ejection head as an embodiment 2 of this invention.

FIG. 5 shows a perspective view of a liquid ejection head as embodiment 2 of this invention. The head of this example comprises an orifice plate (elastic plate) 303 formed with ejection openings 203, a pressure chamber 202 communicating with the ejection openings 203, a common liquid chamber 305 communicating with the pressure chamber 202, and an elastic plate deforming unit 302. The elastic plate deforming unit 302 is directly connected to the elastic plate at its ink ejection side. The elastic plate deforming unit 302 is formed with through-holes at positions facing the ejection openings 203, the through-holes having an opening area such that the ejected ink columns will not contact their inner walls. With this construction the volume of the pressure chamber 202 can be increased, thus reducing the flow resistance of the pressure chamber 202.

With the construction of this embodiment, a pressure chamber wall member 501 that defines the pressure chamber 202 can be formed of silicon. By using an anisotropic etching of (100) silicon, the pressure chamber 202 tapered as shown in FIG. 5 (taper angle: about 55°) was formed. KOH (potassium hydroxide) solution was used as an etchant. In this embodiment too, the ink with 42 cP was able to be separated into a series of droplets at 100 kHz.

Embodiment 3

Figure 6:
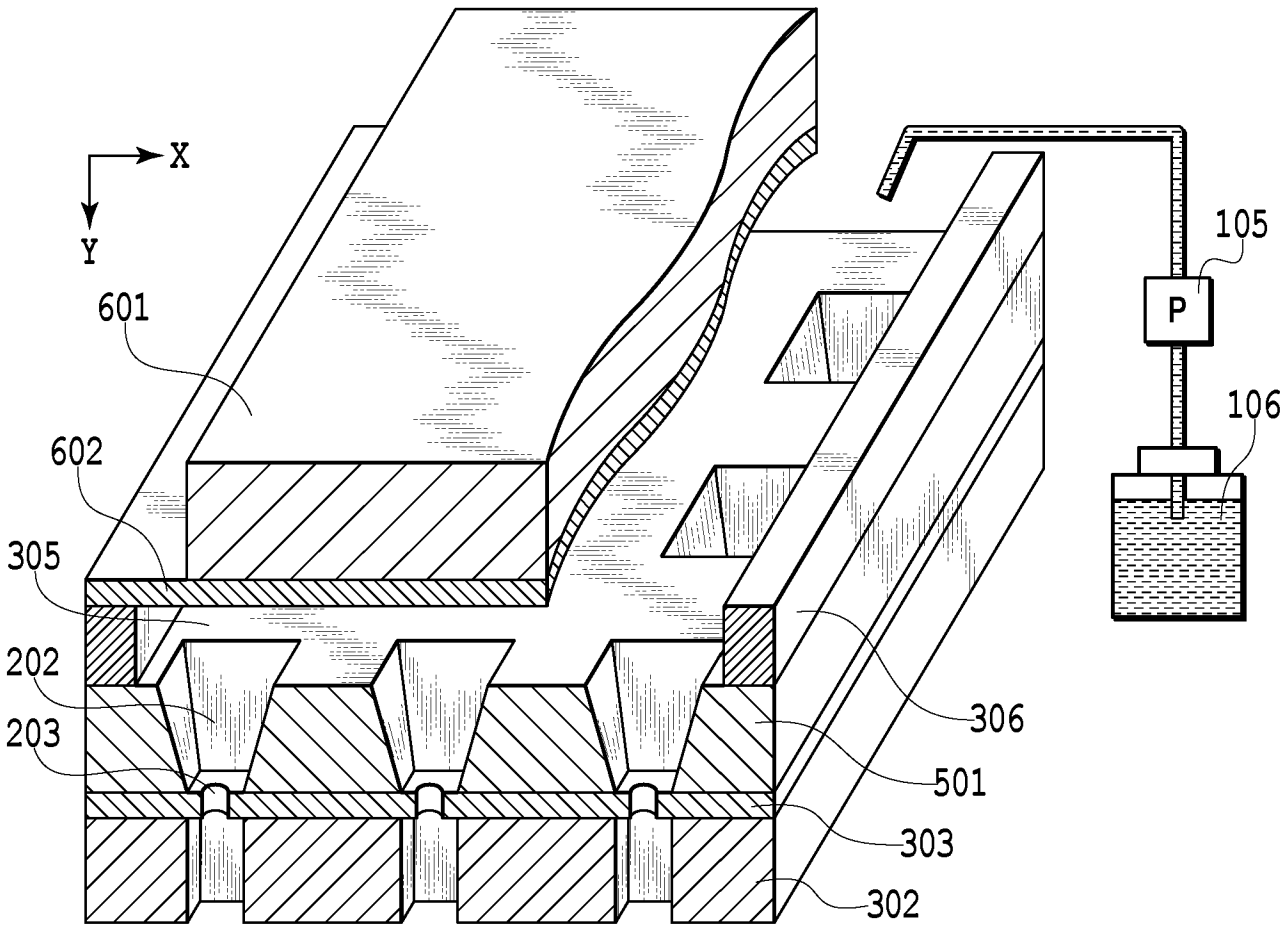
FIG. 6 is a perspective view of a continuous type liquid ejection head as an embodiment 3 of this invention.

FIG. 6 shows a perspective view of a liquid ejection head as embodiment 3 of this invention. This embodiment has a construction which, in addition to the construction of embodiment 2, comprises a vibration plate 602 installed in the common liquid chamber 305 and a liquid vibration unit 601 that applies pressure to the vibration plate 602 to deform it and thereby vibrate the ink in the pressure chamber 202. A suitable material of the liquid vibration unit 601 is a piezoelectric member represented by PZT, as with the elastic plate deforming unit 302, considering a force required to be generated by the liquid ejection head, a displacement of the vibration plate and a drive frequency.

Next, a method of driving the liquid ejection head of this embodiment will be explained. As described in embodiment 1, the elastic plate deforming unit 302 periodically changes the areas of the ejection openings 203 to give direct flow volume changes to the ink columns being ejected from the ejection openings 203. This embodiment performs the following operation in addition to the above. The liquid vibration unit 601 is applied a periodic drive signal for expanding and contracting deformations, which in turn deflect the vibration plate 602 to impart periodic vibrations (pressure fluctuations) to the ink in the common liquid chamber 305 and the pressure chamber 202.

With the above construction, two fluctuations—flow volume fluctuations caused by periodic changes in the areas of the ejection openings 203 in the elastic plate and periodic ink pressure fluctuations caused by the liquid vibration unit 601 can be applied to the ink columns, allowing for more efficient ejection and separation of high viscosity ink into a series of successive droplets.

Further, in this construction, the reduction in the areas of the ejection openings 203 by the elastic plate deforming unit 302 and the reduction in the volumes of the common liquid chamber 305 and the pressure chamber 202 by the liquid vibration unit 601 are set to synchronize with each other to enable flow volume fluctuations of an increased magnitude to be applied to the ink columns being ejected. If the vibrations (pressure fluctuations) caused by the liquid vibration unit 601 lag greatly in reaching the ejection openings 203, it is desired that the timings of applying the drive signals to the liquid vibration unit 601 and to the elastic plate deforming unit 302 be adjusted according to the delay. This allows for more efficient ejection of highly viscous ink and more efficient separation of the ejected ink into a series of successive droplets.

Embodiment 4

Figure 7:
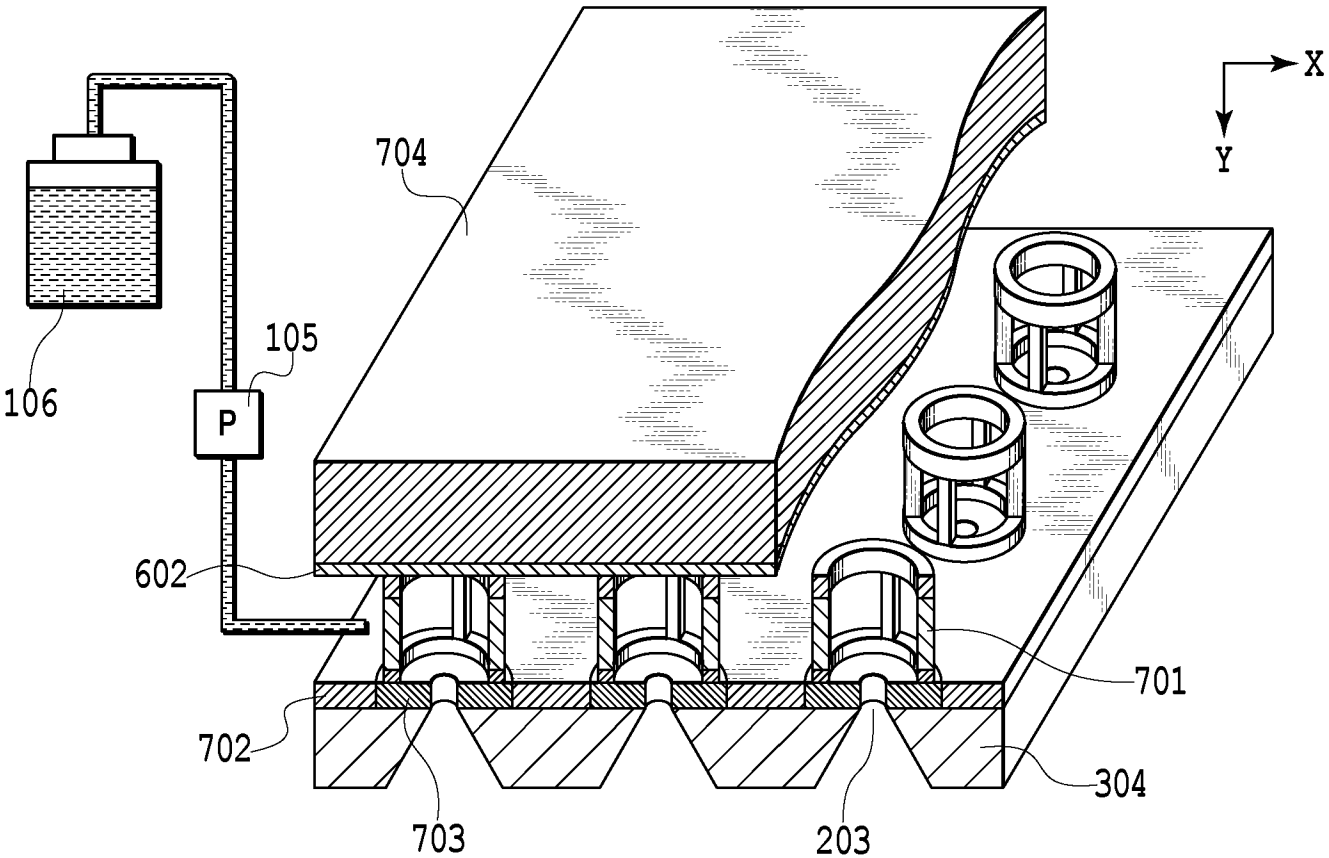
FIG. 7 is a perspective view of a continuous type liquid ejection head as an embodiment 4 of this invention.

FIG. 7 shows a perspective view of a continuous type liquid ejection head as embodiment 4 of this invention. The head construction of this embodiment comprises an elastic plate 703 formed with ejection openings 203, a pressure chamber 202 communicating with the ejection openings 203, a common liquid chamber 305 communicating with the pressure chamber 202, a vibration plate 602 imparting vibrations (pressure fluctuations) to ink, and an elastic plate/vibration plate deforming unit 704 to deform the elastic plate 703 and the vibration plate 602. The elastic plates 703 are demarcated near the ejection openings by an elastic plate demarcation member 702. The vibration plate 602 and the elastic plate 703 are connected through connecting members 701.

The connecting members 701 are connected to the elastic plates 703 near the ejection openings to form individual pressure chambers 202. Each of the connecting members 701 has formed in at least a part thereof a through-hole communicating with the common liquid chamber 305. In this embodiment the connecting members 701 are formed cylindrical but may have any other shape. On the ink ejection side of the elastic plate 703 there is formed an elastic plate holding member 304 that prevents the elastic plate 703 from deforming in the direction of arrow Y. The elastic plate holding member 304 is desirably tapered, as shown in FIG. 7, from the considerations explained in embodiment 1.

Next, a method of driving the head in this embodiment will be explained. When it receives a drive signal, the elastic plate/vibration plate deforming unit 704 deforms the vibration plate 602 in contact with it to vibrate the ink in the pressure chamber 202. The deformation of the vibration plate 602 results in a translational movement of the connecting members 701 in the Y direction causing the elastic plates 703 to deform. The elastic plates 703, since they are demarcated by the elastic plate demarcation member 702, are prevented from deforming outwardly of the pressure chamber 202 but allowed only to deform inwardly to reduce the areas of the ejection openings 203.

With the construction of this embodiment, the deformation of the vibration plate 602 and the deformation of the elastic plate 703 can be achieved by a single deformation unit, allowing for a simplified construction of the head and for a reduction in the drive power.

Further, this construction offers another advantage that, by designing the pressure chamber 202, the connecting members 701 and the elastic plate 703 so that the pressure fluctuations near the ejection openings caused by the vibration plate 602 and the deformations of the elastic plate 703 are synchronized with each other, the ink columns being ejected can be given large flow volume fluctuations highly efficiently.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-177947, filed Aug. 6, 2010, 2011-084591 filed Apr. 6, 2011 which are hereby incorporated by reference herein in their entirety.

What is claimed is:

1. A continuous type liquid ejection head comprising:

an ejection opening plate formed with ejection openings from which to eject a pressurized liquid and made of an elastic plate containing a rubber material at least at portions that are formed with the ejection openings; and a deforming unit which is arranged adjacent to the ejection opening plate and configured to deform the elastic plate so that areas of the ejection openings are periodically changed.

2. A continuous type liquid ejection head according to claim 1, wherein the elastic plate and the deforming unit are directly connected together to transmit a displacement of the deforming unit to the elastic plate.

3. A continuous type liquid ejection head according to claim 1, further comprising a connecting member to transmit a displacement of the deforming unit to the elastic plate.

4. A continuous type liquid ejection head according to claim 1, further comprising:

a pressure chamber communicating with the ejection openings and accommodating a pressurized liquid; and a liquid vibration unit configured to vibrate the liquid in the pressure chamber, wherein changes in the areas of the ejection openings caused by the deforming unit and vibrations of the liquid caused by the liquid vibration unit are synchronized with each other.

5. A continuous type liquid ejection head according to claim 4, wherein reductions in the areas of the ejection openings caused by the deforming unit and reductions in a volume of the pressure chamber caused by the liquid vibration unit are synchronized with each other.

6. A continuous type liquid ejection head according to claim 4, wherein the deforming unit and the liquid vibration unit are the same unit.

7. A continuous type liquid ejection head according to claim 1, wherein the elastic plate contains a silicone rubber.

8. A liquid ejection device comprising:

an ejection opening plate formed with ejection openings from which to eject a pressurized liquid and made of an elastic plate containing a rubber material at least at portions that are formed with the ejection openings; and a deforming unit which is arranged adjacent to the ejection opening plate to deform the elastic plate so that areas of the ejection openings are periodically changed.

* * * * *